US008262400B1

(12) United States Patent
Qu et al.

(10) Patent No.: US 8,262,400 B1
(45) Date of Patent: Sep. 11, 2012

(54) CARD CONNECTOR

(75) Inventors: Zhi-Cheng Qu, New Taipei (TW); Bing-Tao Yang, New Taipei (TW); Yin-Lung Wu, New Taipei (TW); Ming-Chiang Chen, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/186,070

(22) Filed: Jul. 19, 2011

(51) Int. Cl.
*H01R 29/00* (2006.01)

(52) U.S. Cl. ..... 439/188; 439/631; 439/541.5

(58) Field of Classification Search ..... 439/188, 439/630, 631, 159, 541.5
See application file for complete search history.

(56) References Cited

U.S. PATENT DOCUMENTS

| | | | | |
|---|---|---|---|---|
| 7,976,323 | B2 * | 7/2011 | Guo et al. | 439/159 |
| 8,109,774 | B2 * | 2/2012 | Matsunaga | 439/159 |
| 8,152,545 | B1 * | 4/2012 | Qu et al. | 439/188 |
| 8,172,586 | B2 * | 5/2012 | Tsai | 439/159 |

* cited by examiner

*Primary Examiner* — Hien Vu
(74) *Attorney, Agent, or Firm* — WPAT, P.C.; Anthony King

(57) ABSTRACT

A card connector includes an insulating housing defining a first receiving chamber and a second receiving chamber. A fool-proofing member has a pivot pillar vertically pivoted in one side of the insulating housing, a first fool-proofing portion and a second fool-proofing portion protruded on an outside face of the pivot pillar and apart designed at an upper position and a lower position of the pivot pillar at an angle. An elastic element is put around a top of the pivot pillar to make the first fool-proofing portion hidden in the insulating housing and the second fool-proofing portion stretched in the second receiving chamber for receiving one card in the first receiving chamber. The first fool-proofing portion stretches into the first receiving chamber under the rotation drive of the fool-proofing member realized by another card being inserted into the second receiving chamber to push the second fool-proofing portion rearward.

7 Claims, 4 Drawing Sheets

CARD CONNECTOR

BACKGROUND OF THE INVENTION

1. Field of the Invention

The present invention relates to a card connector, and more particularly to a card connector capable of receiving two kinds of different electronic cards therein.

2. The Related Art

With the development of electronic technology, various electronic cards are widely used in electronic products, such as digital cameras, personal digital assistants (PDA) and mobile phones etc. The conventional electronic product defines a card connector so as to receive an electronic card therein. At present, the card connector is improved to often receive two or more kinds of different electronic cards. However, two different electronic cards can be often inserted into the card connector at the same time. As a result, sign communication between the electronic cards and the card connector is often influenced. So, a fool-proofing mechanism is demanded for the card connector to avoid different electronic cards being inserted into the card connector at the same time.

SUMMARY OF THE INVENTION

An object of the present invention is to provide a card connector adapted for receiving two kinds of cards therein. The card connector includes an insulating housing defining a first receiving chamber at a top thereof for receiving one card therein and a second receiving chamber separated from the first receiving chamber and under the first receiving chamber for receiving the other card therein, a plurality of first and second electrical terminals disposed in the insulating housing and respectively stretching into the first receiving chamber and the second receiving chamber for electrically contacting the corresponding card, and a fool-proofing mechanism including a fool-proofing member and an elastic element. The fool-proofing member has a pivot pillar vertically pivoted in a front of one side of the insulating housing, a first fool-proofing portion and a second fool-proofing portion which are protruded on an outside face of the pivot pillar and apart designed at an upper position and a lower position of the pivot pillar at an angle seen from a vertical view. The elastic element is put around a top of the pivot pillar to make the first fool-proofing portion hidden in the front of the one side of the insulating housing and the second fool-proofing portion stretched in the second receiving chamber for blocking the other card from being inserted into the second receiving chamber when the one card is received in the first receiving chamber. The first fool-proofing portion stretches into the first receiving chamber under the rotation drive of the fool-proofing member which is realized by the other card being inserted into the second receiving chamber to push rearward the second fool-proofing portion so as to block the one card from being inserted into the first receiving chamber.

As described above, the card connector of the present invention utilizes the fool-proofing mechanism to avoid two kinds of different cards being inserted into the card connector at the same time. Therefore, an effective sign communication can be achieved between the corresponding card and the card connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
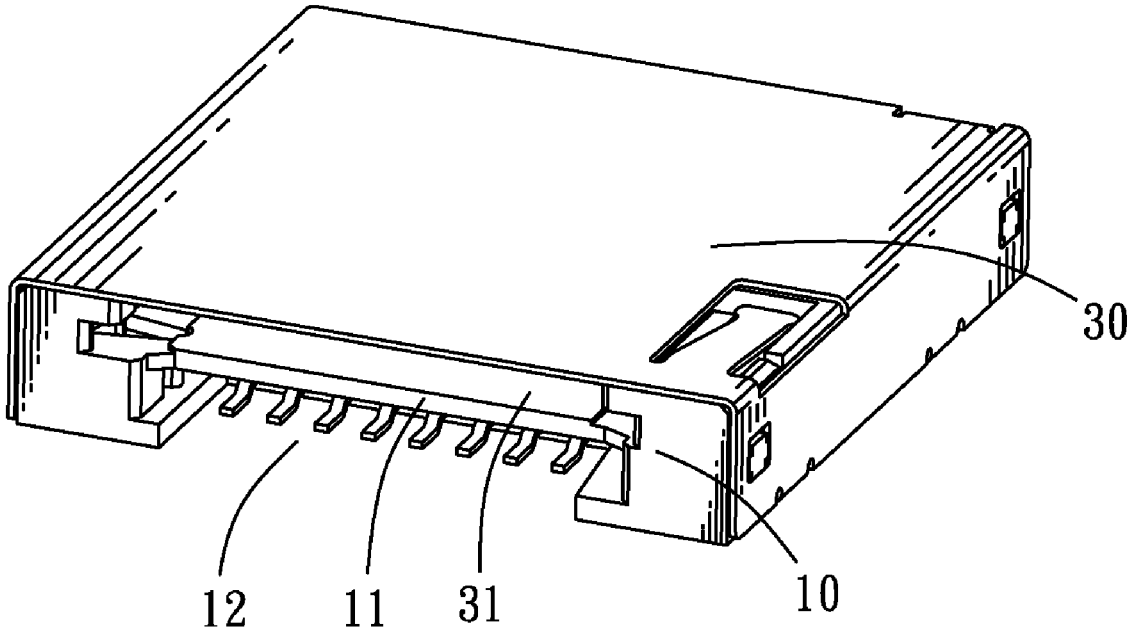
FIG. 1 is an assembled perspective view of a card connector in accordance with an embodiment of the present invention.
Figure 2:
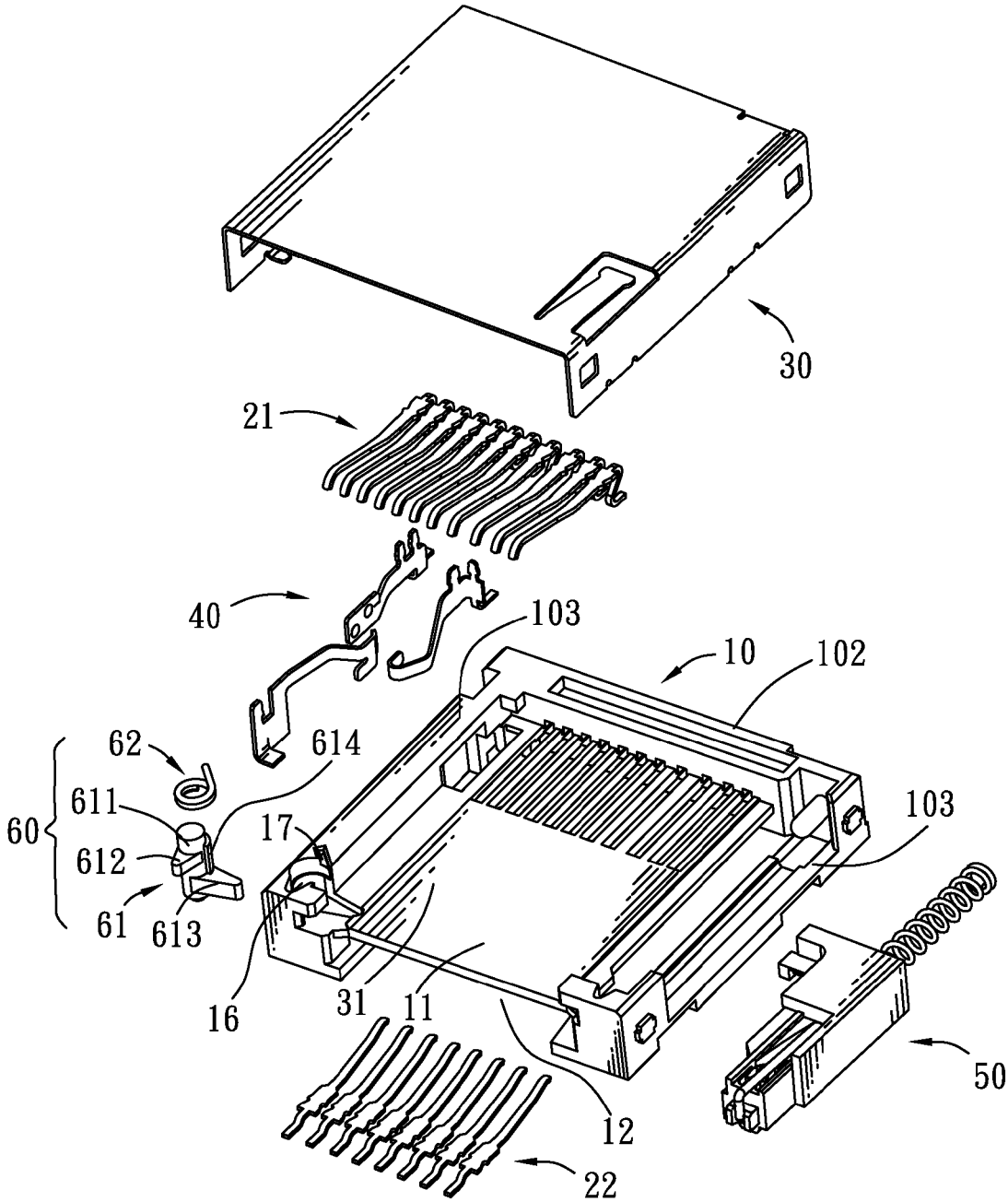
FIG. 2 is an exploded perspective view of the card connector of FIG. 1.

Referring to FIG. 1 and FIG. 2, a card connector in accordance with an embodiment of the present invention includes an insulating housing 10, a plurality of first electrical terminals 21 and second electrical terminals 22, a monitoring terminal group 40, an ejecting device 50, a fool-proofing mechanism 60 and a cover 30.

Figure 3:
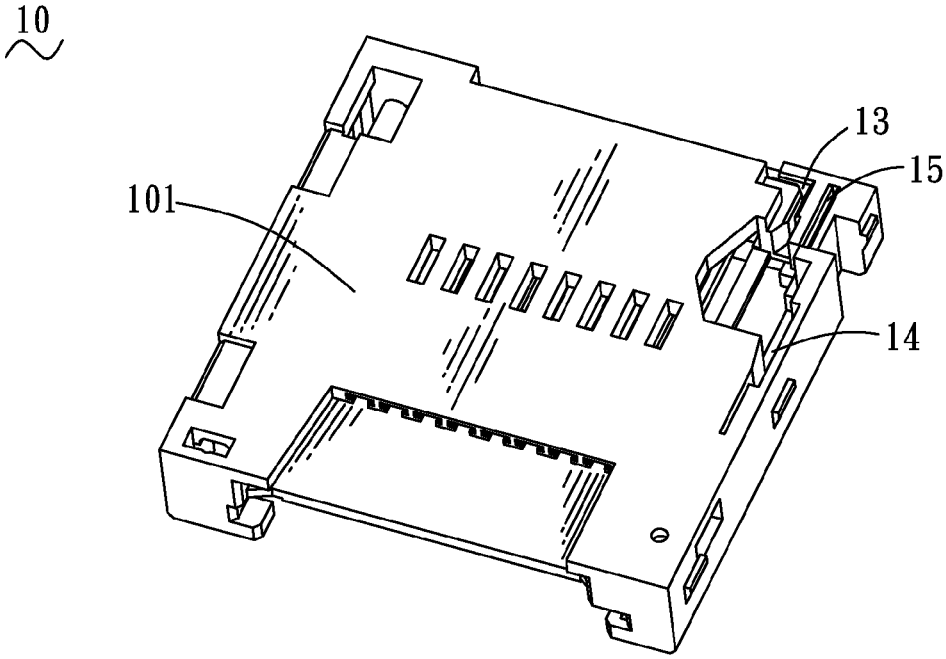
FIG. 3 is a perspective view of an insulating housing of the card connector of FIG. 2.

Referring to FIG. 2 and FIG. 3, the insulating housing 10 has a rectangular base board 101, a rear wall 102 protruding upward from a rear end of the base board 101, and two opposite side walls 103 protruding upward from two opposite side edges of the base board 101 and connected with two ends of the rear wall 102. A rectangular partition 11 extends forward from a substantial middle of an inside of the rear wall 102 and apart parallel to the base board 101 to define a second receiving chamber 12 therebetween so as to receive a second electronic card (not shown) therein. A bottom of one side wall 103 has a substantial middle concaved upward to form a first fastening fillister 14, and a rear concaved upward to form a second fastening fillister 13 and a fastening groove 15 which are parallel to each other. The first fastening fillister 14, the second fastening fillister 13 and the fastening groove 15 each extend along a front-to-rear direction of the side wall 103 and further are connected with one another. The second fastening fillister 13 is further communicated with the second receiving chamber 12. A front of a top of the side wall 103 is concaved downward to form a receiving cavity 16 extending vertically. A rear side of the receiving cavity 16 is further concaved sideward to form a fastening trough 17.

Referring to FIG. 1 and FIG. 2, the cover 30 is coupled onto the insulating housing 10 to define a first receiving chamber 31 between the cover 30 and a top side of the partition 11 for receiving a first electronic card (not shown) therein. The first fastening fillister 14 is further connected with the first receiving chamber 31. The receiving cavity 16 has an upper portion and a lower portion thereof communicated with the first receiving chamber 31 and the second receiving chamber 12 respectively. The first electrical terminals 21 are assembled in a rear of the partition 11 at regular intervals and further project into the first receiving chamber 31. The second electrical terminals 22 are assembled in a front of the base board 101 at regular intervals and further project into the second receiving chamber 12. The ejecting device 50 is mounted in the other side wall 103 of the insulating housing 10 for ejecting the electronic cards out of the card connector.

Figure 5:
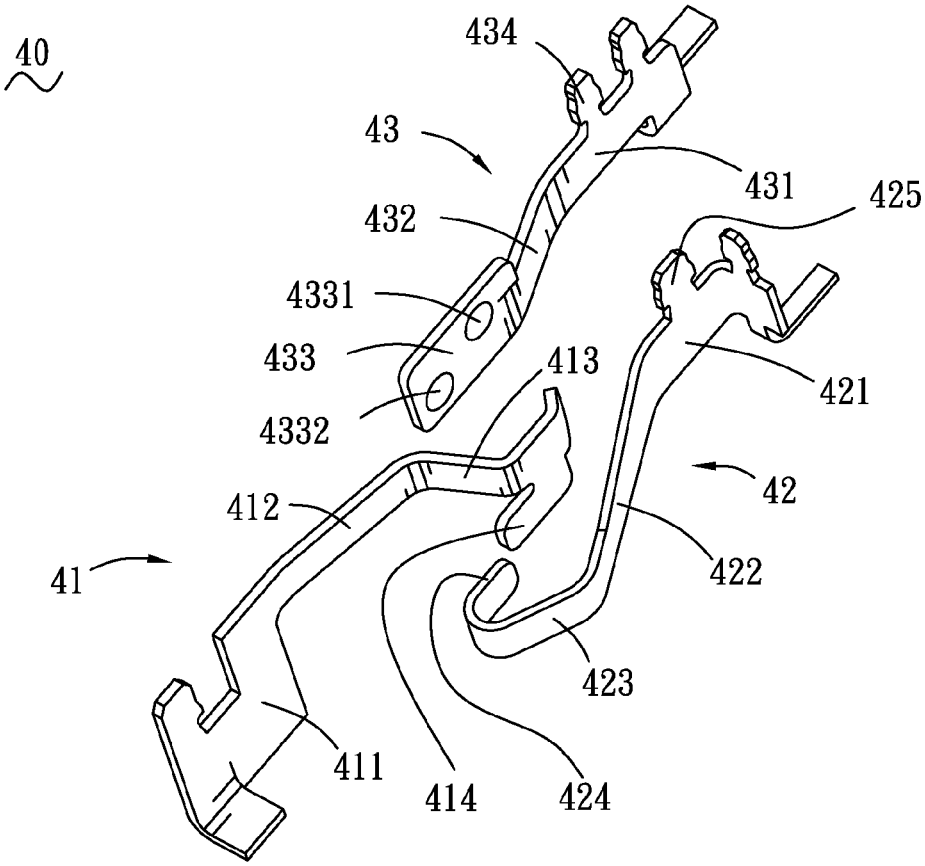
FIG. 5 is a perspective view of a monitoring terminal group of the card connector of FIG. 2.

Referring to FIG. 5, the monitoring terminal group 40 includes a first switch terminal 41, a second switch terminal 42 and a monitoring terminal 43. The first switch terminal 41 has a first fastening plate 411 secured in the first fastening fillister 14 of the insulating housing 10, a first elastic arm 412 extending rearward from a top of a rear edge of the first fastening plate 411 and inclined towards the first receiving chamber 31, a first pressing arm 413 further slantwise extending into the first receiving chamber 31 from a rear edge of the first elastic arm 412, and a first contact portion 414 formed at a free end of the first pressing arm 413. The second switch terminal 42 has a second fastening plate 421 secured in the second fastening fillister 13 of the insulating housing 10, a second elastic arm 422 extending forward from a front edge of the second fastening plate 421 and inclined towards the second receiving chamber 12, a second pressing arm 423 further extending forward from a front edge of the second elastic arm 422 and inclined oppositely to the second receiving chamber 12, and a second contact portion 424 bent rearward from a free end of the second pressing arm 423, wherein the second pressing arm 423 is further exposed in the second receiving chamber 12. A top edge of the second fastening plate 421 protrudes upward to form a fastening ear 425 inserted in a top side of the second fastening fillister 13. The monitoring terminal 43 has a fastening strip 431 fastened in the fastening groove 15 of the insulating housing 10, a connecting strip 432 extending forward from a front edge of the fastening strip 431 and inclined towards the second switch terminal 42, and a contact plate 433 extending forward from a free edge of the connecting strip 432. A first contact lump 4331 and a second contact lump 4332 are protruded on a side of the contact plate 433, and apart face the first contact portion 414 and the second contact portion 424 respectively. A top edge of the fastening strip 431 protrudes upward to form a plurality of fixing ears 434 inserted in a top side of the fastening groove 15.

Figure 4:
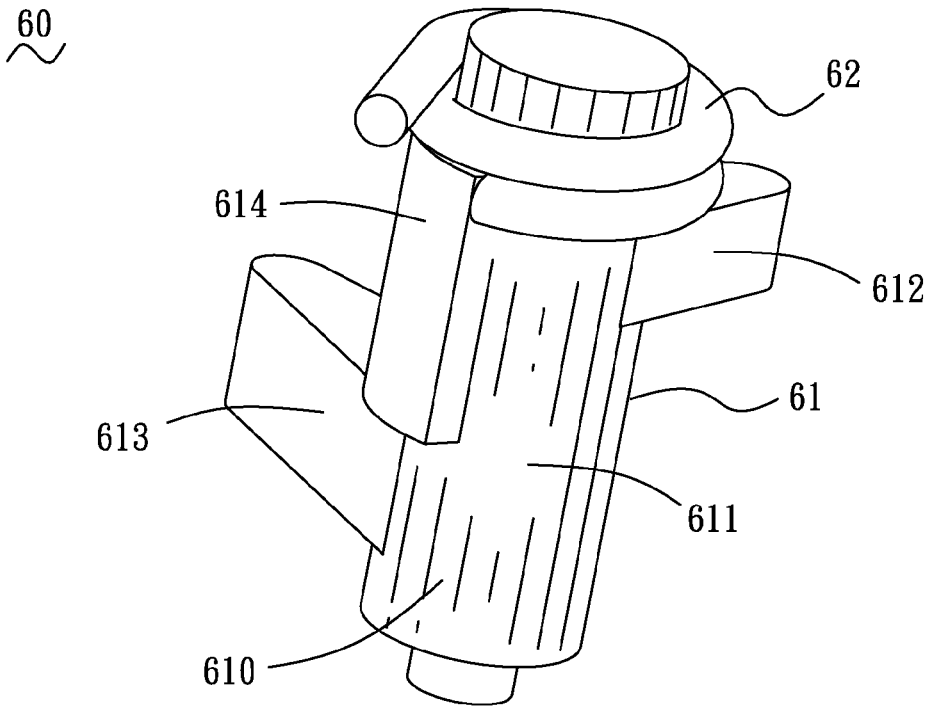
FIG. 4 is a perspective view of a fool-proofing mechanism of the card connector of FIG. 2.
Figure 6:
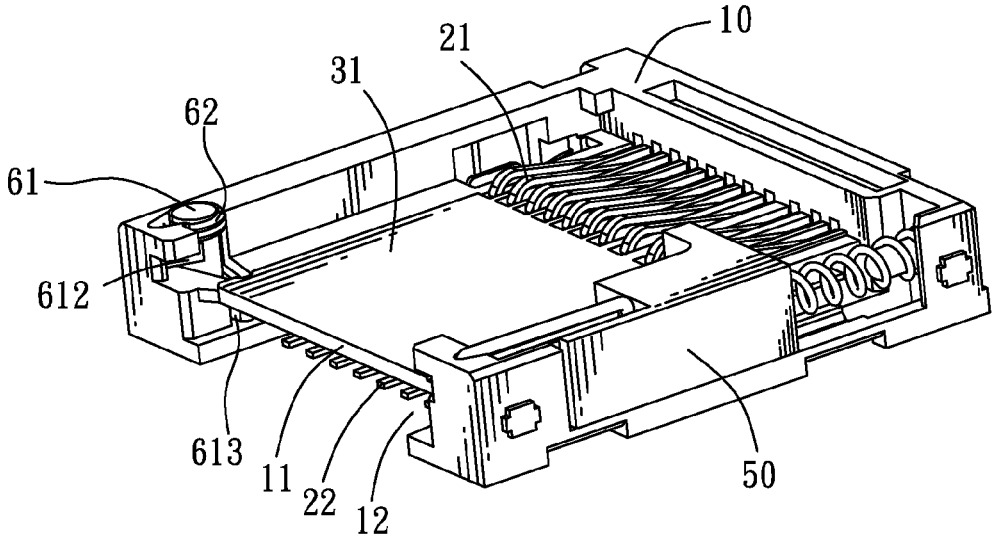
FIG. 6 is a partially assembled perspective view of the card connector of FIG. 1 without a cover.

Referring to FIG. 2, FIG. 4 and FIG. 6, the fool-proofing mechanism 60 includes a fool-proofing member 61 and an elastic element. The fool-proofing member 61 has a pivot pillar 611 of a column shape vertically pivoted in the receiving cavity 16 of the insulating housing 10, a first fool-proofing portion 612 and a second fool-proofing portion 613 which are protruded on an outside periphery face 610 of the pivot pillar 611 and apart designed at an upper position and a lower position of the pivot pillar 611 to substantially realize a right angle therebetween seen from a vertical view. The outside periphery face 610 of the upper position of the pivot pillar 611 further protrudes outward to form a biasing portion 614. In this embodiment, the elastic element is a torsional spring 62 put around a top of the pivot pillar 611, with one end thereof being fastened in the fastening trough 17 and the other end thereof resisting against a distal side of the biasing portion 614. At an initial condition of the card connector, the first fool-proofing portion 612 of the fool-proofing member 61 is hidden in the front of the side wall 103 for the convenience of the first electronic card being capable of being inserted into the first receiving chamber 31, and the second fool-proofing portion 613 stretches into the second receiving chamber 12 for blocking the second electronic card from being inserted into the second receiving chamber 12 when the first electronic card is received in the first receiving chamber 31. When the second electronic card needs to be inserted into the second receiving chamber 12 of the insulating housing 10, the first electronic card is withdrawn out of the first receiving chamber 31, and the insertion of the second electronic card pushes rearward the second fool-proofing portion 613 of the fool-proofing member 61 to drive the fool-proofing member 61 to rotate rearward. At this time, the second electronic card can be inserted into the second receiving chamber 12 of the insulating housing 10, and the first fool-proofing portion 612 rotates rearward to stretch into the first receiving chamber 31 so as to block the first electronic card from being inserted into the first receiving chamber 31. The torsional spring 62 is at an elastic compressed state under the bias action of the biasing portion 614. When the second electronic card is withdrawn out of the second receiving chamber 12 of the card connector, the fool-proofing member 61 rotates back by virtue of the elasticity of the torsional spring 62. So, the first electronic card and the second electronic card cannot be inserted in the card connector at the same time, and a good fool-proofing effect is realized by the card connector.

Referring to FIGS. 1-5, when the first electronic card is inserted into the first receiving chamber 31 of the insulating housing 10, the first electronic card presses sideward the first pressing arm 413 of the first switch terminal 41 to realize an electrical connection between the first contact portion 414 and the first contact lump 4331 of the monitoring terminal 43 so as to monitor whether the first electronic card is inserted in place. When the second electronic card is inserted into the second receiving chamber 12 of the insulating housing 10, the second electronic card presses sideward the second pressing arm 423 of the second switch terminal 42 to realize an electrical connection between the second contact portion 424 and the second contact lump 4332 of the monitoring terminal 43 so as to monitor whether the second electronic card is inserted in the place. So, the monitoring terminal 43 can be shared by the first switch terminal 41 and the second switch terminal 42 to respectively monitor the insertion of the first electronic card and the second electronic card. It effectively saves a space occupied by the monitoring terminal group 40 in the card connector, and takes a relatively low manufacture cost.

As described above, the card connector of the present invention utilizes the fool-proofing mechanism 60 to avoid two kinds of different electronic cards being inserted into the card connector at the same time. Therefore, an effective sign communication can be achieved between the corresponding electronic card and the card connector.

What is claimed is:

1. A card connector adapted for receiving two kinds of cards therein, comprising:

an insulating housing defining a first receiving chamber at a top thereof for receiving one card therein and a second receiving chamber separated from the first receiving chamber and under the first receiving chamber for receiving the other card therein;

a plurality of first and second electrical terminals disposed in the insulating housing and respectively stretching into the first receiving chamber and the second receiving chamber for electrically contacting the corresponding card; and a fool-proofing mechanism including a fool-proofing member and an elastic element, the fool-proofing member having a pivot pillar vertically pivoted in a front of one side of the insulating housing, a first fool-proofing portion and a second fool-proofing portion which are protruded on an outside face of the pivot pillar and apart designed at an upper position and a lower position of the pivot pillar at an angle seen from a vertical view, the elastic element being put around a top of the pivot pillar to make the first fool-proofing portion hidden in the front of the one side of the insulating housing and the second fool-proofing portion stretched in the second receiving chamber for blocking the other card from being inserted into the second receiving chamber when the one card is received in the first receiving chamber, the first fool-proofing portion stretching into the first receiving chamber under the rotation drive of the fool-proofing member which is realized by the other card being inserted into the second receiving chamber to push rearward the second fool-proofing portion so as to block the one card from being inserted into the first receiving chamber;

wherein the outside face of the upper position of the pivot pillar further protrudes outward to form a biasing portion, the elastic element is a torsional spring with one end thereof being fastened in the insulating housing and the other end thereof resisting against a distal side of the biasing portion.

2. The card connector as claimed in claim 1, wherein the first fool-proofing portion and the second fool-proofing portion are designed to substantially show a right angle therebetween seen from the vertical view.

3. The card connector as claimed in claim 1, further comprising a monitoring terminal group which includes a first switch terminal, a second switch terminal and a monitoring terminal, the monitoring terminal having a fastening strip fastened in the one side of the insulating housing and a contact plate, the first switch terminal having a first fastening plate fastened in the one side of the insulating housing, a first pressing arm slantwise extending into the first receiving chamber and a first contact portion formed at a distal end of the first pressing arm and capable of elastically contacting the contact plate of the monitoring terminal under the action of the one card pressing sideward the first pressing arm, the second switch terminal having a second fastening plate fastened in the one side of the insulating housing between the second receiving chamber and the monitoring terminal, a second pressing arm slantwise stretching into the second receiving chamber and a second contact portion formed at a distal end of the second pressing arm and capable of elastically contacting the contact plate of the monitoring terminal under the action of the other card pressing sideward the second pressing arm.

4. The card connector as claimed in claim 3, wherein the contact plate of the monitoring terminal has one side thereof designed with a first contact lump and a second contact lump thereon which apart face the first contact portion of the first switch terminal and the second contact portion of the second switch terminal so as to realize an electrical connection with the first contact portion and the second contact portion respectively.

5. The card connector as claimed in claim 3, wherein the monitoring terminal further has a connecting strip extending forward from a front edge of the fastening strip and inclined towards the second switch terminal, the contact plate is formed by extending forward from a front edge of the connecting strip.

6. The card connector as claimed in claim 3, wherein the first switch terminal further has a first elastic arm extending rearward from a top of a rear edge of the first fastening plate and inclined towards the first receiving chamber, the first pressing arm is formed by slantwise extending rearward from a rear edge of the first elastic arm.

7. The card connector as claimed in claim 3, wherein the second switch terminal further has a second elastic arm extending forward from a front edge of the second fastening plate and inclined towards the second receiving chamber, the second pressing arm is formed by further extending forward from a front edge of the second elastic arm and inclined oppositely to the second receiving chamber, the second contact portion is bent rearward from a free end of the second pressing arm.

* * * * *